US005631095A

United States Patent [19]

Kanasashi

[11] Patent Number: 5,631,095

[45] Date of Patent: May 20, 1997

[54] MULTILAYERED COATED CORROSION RESISTANT STEEL MATERIAL

[75] Inventor: Toshio Kanasashi, Mishima, Japan

[73] Assignee: Usui Kokusai Sangyo Kaisha Ltd., Japan

[21] Appl. No.: 541,223

[22] Filed: Oct. 12, 1995

Related U.S. Application Data

[63] Continuation of Ser. No. 390,385, Feb. 17, 1995, abandoned, which is a continuation of Ser. No. 163,884, Dec. 8, 1993, abandoned, which is a continuation of Ser. No. 3,796, Jan. 13, 1993, abandoned, which is a continuation of Ser. No. 871,037, Apr. 20, 1992, abandoned, which is a continuation of Ser. No. 348,856, May 8, 1989, abandoned, which is a continuation of Ser. No. 176,456, Apr. 1, 1988, Pat. No. 4,849,301, which is a continuation of Ser. No. 882,347, Jul. 7, 1986, abandoned.

[30] Foreign Application Priority Data

Aug. 8, 1985 [JP] Japan ..... 60-172236

[51] Int. Cl.[6] ..... B32B 15/08

[52] U.S. Cl. ..... 428/623; 428/626; 428/659

[58] Field of Search ..... 428/626, 632, 428/658, 659, 623

[56] References Cited

U.S. PATENT DOCUMENTS

| | | | |
|---|---|---|---|
| 4,216,272 | 8/1980 | Clauss | 428/632 |
| 4,314,893 | 2/1982 | Clauss | 204/40 |
| 4,411,964 | 10/1983 | Hara et al. | 428/626 |
| 4,500,610 | 2/1985 | Gunn et al. | 428/624 |
| 4,692,382 | 9/1987 | Schmitt et al. | 428/421 |
| 4,707,415 | 11/1987 | Ikeda et al. | 428/621 |
| 4,849,301 | 7/1989 | Kanashi | 428/623 |

FOREIGN PATENT DOCUMENTS 162292 9/1984 Japan .

*Primary Examiner*—John Zimmerman

*Attorney, Agent, or Firm*—Anthony J. Casella; Gerald E. Hespos

[57] ABSTRACT

Multilayered coated corrosion resistant steel material having a galvanized layer on one surface thereof, an electrodeposited layer on said galvanized layer formed from a zinc-based alloy containing nickel and having a thickness of one to six microns; and a resin layer on said electrodeposited layer.

4 Claims, 1 Drawing Sheet

MULTILAYERED COATED CORROSION RESISTANT STEEL MATERIAL

This application is a continuation of application Ser. No. 08/390,385 filed Feb. 17, 1995, now abandoned; which was a continuation of application Ser. No. 08/163,884 filed Dec. 8, 1993, now abandoned; which was a continuation of application Ser. No. 08/003,796 filed Jan. 13, 1993, now abandoned; which in turn was a continuation of application Ser. No. 07/871,037 filed Apr. 20, 1992, now abandoned; which was a continuation of application Ser. No. 07/348,856, filed May 8, 1989, now abandoned; which was a continuation of application Ser. No. 07/176,456 filed Apr. 1, 1988, now U.S. Pat. No. 4,849,301; which was a continuation of application Ser. No. 882,347 filed Jul. 7, 1986, now abandoned.

BACKGROUND OF THE INVENTION

1. Field of the Invention

This invention relates to a steel material having on its surface a multilayer protective coating which makes it resistance to wear and corrosion.

2. Description of the Prior Art

A known multilayer-coated corrosion-resistant steel material is shown by way of example in FIG. 3. It comprises, for example, a steel sheet 11 having a galvanised layer 12 formed on its surface 11', a chromate film 13 on the galvanised layer 12 and a resin layer 14 on the chromate film 13.

Although zinc is often used to provide a protective coating on steel, the zinc layer must be of considerable thickness in order to protect the steel from corrosion effectively, since the protection of steel by means of a galvanised layer results from sacrificial corrosion of the zinc.

The galvanised layer 12 must have a thickness of at least about 30 microns in view of the severe natural conditions to which the coated material will be exposed when it is, for example, to be used for making motor vehicle parts. The formation of such a thick layer is time-consuming which brings about a drastic reduction in productivity. As the galvanised layer 12 is so thick, it tends to crack or peel away when the coated material is pressed or bent into a desired shape. Moreover, the resin layer 14 tends to have pinholes and is also liable to crack when the coated material is pressed or bent. The corrosion product of the zinc tends to accumulate quickly in the pinholes or cracks of the resin layer 14 despite the presence of the chromate film 13. As a result, the resin layer 14 tends to peel away as the chromate film 13 loses it effectiveness, particularly when the coated material is used to make, for example, motor vehicle parts and is exposed to highly corrosive conditions including large temperature variations.

SUMMARY OF THE INVENTION

Under these circumstances, it is an object of this invention to provide an improved multilayer coated steel material which can maintain a high degree of corrosion resistance for a long period of time even under highly corrosive conditions.

This invention provides a multilayer coated steel material which comprises a steel base, a galvanised layer formed on one surface of the steel base, an electrodeposited layer of a zinc-based alloy containing nickel formed on the galvanised layer and having a thickness of one to six microns and a synthetic resin layer formed on the electroplated layer.

The multilayer coated material may further include a chromate film between the electroplated layer and the resin layer.

The steel base may, for example, be in the form of a sheet, tube, bar or wire.

The provision of the electrodeposited layer makes it possible to reduce the thickness of the galvanised layer drastically without bringing about any increase in the overall thickness of the coating. The reduced thickness of the galvanised layer enables it to be formed more quickly. The reduced thickness of the galvanised layer and the ductability of the electroplated layer which nickel imparts to it ensure that no cracking or peeling of the galvanised or electroplated layer occurs when the coated material is shaped. There is no undesirably rapid accumulation of the corrosion product of the zinc in the pinholes of the resin layer or in any portions of the resin layer which have been damaged during the mechanical shaping of the coated material. There is no serious peeling of the resin layer.

The shortening of the galvanising time means a high rate of productivity. The improved resistance of the coating to cracking or peeling enable the coated material to be mechanically processed with only a small amount of wastage.

The coated material of this invention can maintain a high degree of corrosion resistance for a long period of time even in a highly-corrosive environment in which great temperature variations occur. Therefore it is very useful for making, for example, structural parts for motor vehicles.

DETAILED DESCRIPTION OF THE INVENTION

Figure 1:
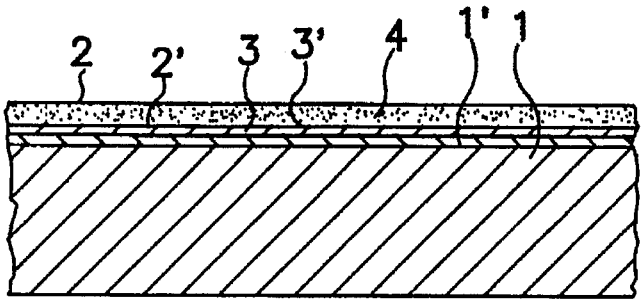
FIG. 1 is a fragmentary enlarged cross-sectional of coated steel sheet embodying this invention.

Referring to FIG. 1, the coated material embodying this invention comprises a steel sheet 1 having a surface 1' which has been subjected to preliminary treatment including degreasing and rust removal. The surface 1' carries thereon a galvanised layer 2 having a thickness of, about, 8 to 20 microns. The galvanised layer 2 has a surface 2' which carries thereon an electrodeposited layer 3 of a zinc-based alloy containing 5 to 15% by weight of nickel. The layer 3 has a thickness of one to six microns, depending on its nickel content. If its thickness is smaller than one micro, it tends to display unsatisfactory corrosion resistance. If its thickness is greater than six microns, it lowers the workability of the coated material. The layer 3 has a surface 3' which carries thereon a layer 4 of a synthetic resin having a high degree of wear resistance. The layer 4 may, for example, be formed from a polyolefin resin, a chlorine-containing resin, a fluorine-containing resin, an epoxy resin or a polyamide resin.

Figure 2:
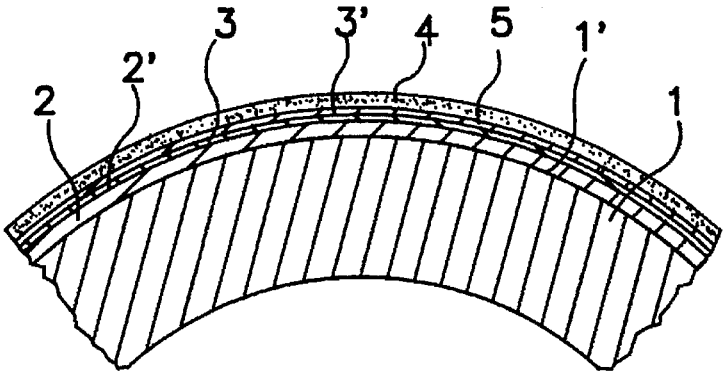
FIG. 2 is a fragmentary enlarged cross-sectional view of coated steel tube embodying this invention.
Figure 3:
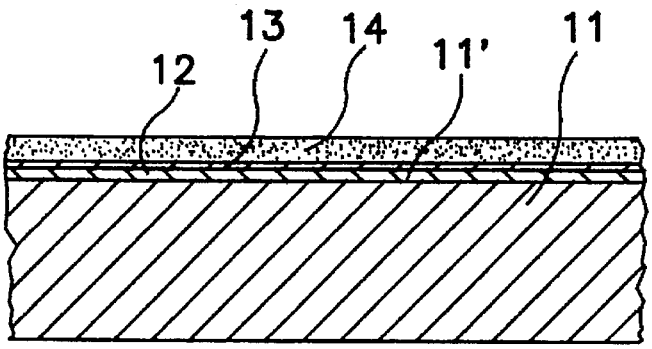
FIG. 3 PRIOR ART
FIG. 3 is a fragmentary enlarged cross-sectional view of a coating steel sheet which is already known in the art.

The coated material shown in FIG. 2 is in the shape of a steel tube and has a multilayer coating on its outer wall surface. The coating is essentially identical to that which has hereinabove been described with reference to FIG. 1, except that the material of FIG. 2 further includes a chromate film 5 between the electroplated layer 3 and the resin layer 4.

The surface 1' may either be a plain steel surface or a surface carrying a thin film of copper.

The invention will now be described more specifically with reference to a number of examples.

EXAMPLE 1

A tube of ISO 2604(2-75) steel having an outside diameter of 8.0 mm, a wall thickness of 0.7 mm and a length of 300 mm was subjected to degreasing and rust removal treatment by a customary method.

The tube was arranged as a cathode, and a zinc plate as an anode, in an alkaline galvanising bath containing mainly sodium cyanide and sodium hydroxide. While the bath was maintained at ambient temperature, an electric current was passed through it so that the cathode would have a current density of 3 A/dm$^2$, and as a result a galvanised zinc layer having a thickness of about 13 microns was formed on the surface of the tube.

The tube was immersed in a dilute aqueous solution of hydrochloric acid and was thereafter washed with water. The tube was arranged as a cathode in an electroplating bath containing mainly zinc chloride, nickel chloride, ammonium chloride and boric acid and at a pH of 5.8, whilst a plate of a zinc-based alloy containing nickel was used as an anode. While the bath was maintained at a temperature of 40° C., an electric current was passed through at so that the cathode would have a current density of 2 A/dm$^2$, and as a result an electrodeposited layer of the alloy having a thickness of about five microns was formed on the galvanised layer.

An epoxy resin primer was sprayed onto the electroplated layer and backed on at a temperature of 200° C. After it had been cooled, a vinylidene fluoride resin was sprayed onto the primer and backed on at a temperature of 250° C., as a result of which a resin layer having a thickness of about 35 microns was formed on the electroplated layer.

EXAMPLE 2

A tube of ISO 2604(2-75) steel having an outside diameter of 8.0 mm, a wall thickness of 0.7 mm and a length of 300 mm was subjected to degreasing and rust removal treatment by a conventional method. It had an outer surface coated with a film of copper having a thickness of three microns.

The tube was arranged as a cathode in a galvanising bath containing mainly zinc sulfate, sodium sulfate and aluminium chloride and at temperature of 50° C. An electric current was passed through the bath such that the cathode would have a current density of 20 A/dm$^2$. A galvanised layer having a thickness of about 15 microns was formed on the surface of the tube.

The electroplating procedure of Example 1 was repeated for forming an electrodeposited layer having a thickness of about four microns on the galvanised layer.

A dispersion containing vinyl fluoride was sprayed onto the electroplated layer and baked on at a temperature of 250° C., thus forming a resin layer having a thickness of about 30 microns.

Comparative Example 1

The procedure of Example 1 was repeated thus forming a galvanised layer having a thickness of about 20 microns on a tube of the same steel having the same dimensions. A conventional chromate film was formed on the galvanised layer. The procedure of Example 1 was repeated for forming on the chromate film a resin layer composed of vinylidene fluoride and having a thickness of about 35 microns.

Repeated cycles of corrosion tests were conducted on the coated products of Examples 1 and 2 and Comparative Example 1. Each cycle consisted of four hours of an ISO 3768 test (neutral salt spray test for metallic coatings), two hours of drying at a temperature of 60° C. and two hours of a wetting test at a temperature of 50° C. and a humidity of at least 95%. The test results are shown in the following table.

TABLE 1

| Cycles | 100 | 150 | 200 | 250 | 300 | 350 | 400 |
|---|---|---|---|---|---|---|---|
| Example 1 | — | — | White rust | — | Red rust | Streaks of red rust | More streaks of red rust |
| Example 2 | — | — | White rust | Red rust | — | Streaks of red rust | More streaks of red rust |
| Comparative Example 1 | White rust | — | Red rust | Streaks of red rust | More streaks of red rust | | |

I claim:

1. A multilayer coated corrosion resistant steel material which has on its surface a multilayer protective coating said multilayer coated corrosion resistant steel material consisting essentially of a steel base having at least one surface; a galvanized zinc layer having a thickness between approximately 8–20 microns thick on said steel surface; an electroplated deposited layer of zinc based alloy containing 5–15% by weight nickel deposited on said galvanized zinc layer and having a thickness of one to six microns; and a vinyl fluoride resin layer on said electroplated layer.

2. A multilayer corrosion resistant material as set forth in claim 1, wherein the galvanized layer has a thickness of about 15 microns.

3. A multilayer coated corrosion resistant material as set forth in claim 1 wherein the Zn-Ni alloy layer is provided with a chromate layer beneath the resin layer.

4. A multilayer coated corrosion resistant steel material which has on its surface a multilayer protective coating, said multilayer coated corrosion resistant material consisting of a steel base having at least one surface having a first galvanized zinc layer between 8–20 microns thick on said steel surface; an electroplated deposited layer of zinc based alloy containing 5–15% by weight nickel deposited on said galvanized zinc layer and having a thickness of one to six microns; a chromate layer on said electrodeposited layer of zinc based alloy; and a resin layer on said chromate layer which consists essentially of a vinyl fluoride resin.

* * * * *